US007998284B2

(12) United States Patent
Takeda et al.

(10) Patent No.: US 7,998,284 B2
(45) Date of Patent: Aug. 16, 2011

(54) GRAIN-ORIENTED ELECTRICAL STEEL SHEET HAVING HIGH TENSILE STRENGTH INSULATING FILM AND METHOD OF TREATMENT OF SUCH INSULATING FILM

(75) Inventors: Kazutoshi Takeda, Tokyo (JP); Fumiaki Takahashi, Tokyo (JP); Shuichi Yamazaki, Tokyo (JP); Hiroyasu Fujii, Tokyo (JP); Fumikazu Andou, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 225 days.

(21) Appl. No.: 12/227,205

(22) PCT Filed: May 18, 2007

(86) PCT No.: PCT/JP2007/060649

§ 371 (c)(1), (2), (4) Date: Nov. 10, 2008

(87) PCT Pub. No.: WO2007/136115

PCT Pub. Date: Nov. 29, 2007

(65) Prior Publication Data

US 2009/0233114 A1 Sep. 17, 2009

(30) Foreign Application Priority Data

May 19, 2006 (JP) ..... 2006-140689

(51) Int. Cl.
*H01F 1/14* (2006.01)
*H01F 1/18* (2006.01)

(52) U.S. Cl. ..... 148/308; 148/111; 148/113

(58) Field of Classification Search ..... None
See application file for complete search history.

(56) References Cited

U.S. PATENT DOCUMENTS

| | | | | |
|---|---|---|---|---|
| 3,720,549 | A | 3/1973 | Hirst et al. | |
| 3,856,568 | A | 12/1974 | Tanaka et al. | |
| 3,996,073 | A * | 12/1976 | Evans | 428/428 |
| 4,032,366 | A * | 6/1977 | Choby, Jr. | 148/113 |
| 2003/0136470 | A1 | 7/2003 | Takashima et al. | |
| 2008/0190520 | A1 * | 8/2008 | Watanabe et al. | 148/537 |

FOREIGN PATENT DOCUMENTS

| | | |
|---|---|---|
| JP | 53-28375 | 8/1978 |
| JP | 54-143737 | 11/1979 |
| JP | 57-9631 | 2/1982 |
| JP | 61-041778 | 2/1986 |
| JP | 1-147074 | 6/1989 |
| JP | 7-268567 | 10/1995 |
| JP | 08-239771 | * 9/1996 |
| JP | 11-071683 | 3/1999 |
| JP | 2000-178760 | 6/2000 |

(Continued)

OTHER PUBLICATIONS

Machine Translation of JP 2002-180134.*

(Continued)

*Primary Examiner* — John P Sheehan
(74) *Attorney, Agent, or Firm* — Kenyon & Kenyon LLP

(57) ABSTRACT

Grain-oriented electrical steel sheet having a chrome-free high tensile strength insulating film characterized by comprising steel sheet on the surface of which is formed an insulating film containing a phosphate and colloidal silica as main ingredients and containing crystalline magnesium phosphate uniformly dispersed over the entire surface.

7 Claims, 4 Drawing Sheets

FOREIGN PATENT DOCUMENTS

| | | | |
|---|---|---|---|
| JP | 2001-152354 | | 6/2001 |
| JP | 2002-180134 | | 6/2002 |
| JP | 2004-346348 | * | 12/2004 |
| JP | 2005-240079 | | 9/2005 |

OTHER PUBLICATIONS

Machine Translation of JP 08-239771.*

Derwent-Acc-No. 2005-033914, Abstract of JP 2004-346348.*

Machine Translation of JP 2005-346348.*

International Search Report dated Jul. 10, 2007 issued in corresponding PCT Application No. PCT/JP2007/060649.

European Search Report dated Apr. 4, 2011 issued in corresponding European Application No. 07 74 4083.

* cited by examiner

GRAIN-ORIENTED ELECTRICAL STEEL SHEET HAVING HIGH TENSILE STRENGTH INSULATING FILM AND METHOD OF TREATMENT OF SUCH INSULATING FILM

TECHNICAL FIELD

The present invention relates to grain-oriented electrical steel sheet having a chrome-free high tensile strength insulating film and to a method of treatment of an insulating film forming a chrome-free high tensile strength insulating film.

BACKGROUND ART

The surface of grain-oriented electrical steel sheet is formed with an insulating film comprised of the two layers of a forsterite film called a "primary film" formed after cold rolling and decarburizing annealing during high temperature final annealing and a phosphate film formed by coating and baking a treatment solution mainly comprised of a phosphate etc. after the final annealing at the same time as the flattening.

The forsterite film plays an important role in improving the adhesion of the steel sheet and phosphate film.

The phosphate film is a film required for imparting a high electrical insulating ability to the grain-oriented electrical steel sheet and reducing the eddy current loss to improve the watt loss. The above film is being asked to provide, in addition to an insulating ability, various properties such as adhesion, heat resistance, slip, and corrosion resistance.

When working grain-oriented electrical steel sheet to produce a core of a transformer etc., if the film is degraded in adhesion, heat resistance, or slip, the film will peel off at the time of the stress-relief annealing whereby the inherent performance of the film will not be expressed or the steel sheet will not be able to be smoothly stacked and the work efficiency will be degraded.

If using an insulating film to impart tensile strength to the surface of electrical steel sheet, movement of the magnetic domain walls becomes easier and as a result the watt loss is reduced and the magnetic properties are improved. Imparting tensile strength is also effective for reducing the magnetostriction—which is one of the main causes of transformer noise.

Japanese Patent Publication (B2) No. 53-28375 discloses a method of coating a forsterite film formed on surface of steel sheet after final annealing with an insulating film treatment solution mainly comprised of a phosphate, chromate, and colloidal silica and baking it to form a high tensile strength insulating film and thereby reduce the watt loss and magnetostriction.

Further, Japanese Patent Publication (A) No. 61-41778 discloses a method of coating a treatment solution containing superfine particles of colloidal silica having a particle size of 8 μm or less, a primary phosphate, and a chromate in specific ratios and baking it on to hold the tensile strength of the insulating film at a high tensile strength level and improve the lubricating ability of the film.

Furthermore, Japanese Patent Publication (A) No. 11-71683 discloses the technology relating to grain-oriented electrical steel sheet having a high tensile strength mainly comprised of a phosphate, chromate, and colloidal silica having a glass transition point of 950 to 1200° C.

According to the technology disclosed in the above publications, various types of film properties are remarkably improved and, further, the film tensile strength is also improved, but the insulating film contains the chrome compound of a chromate.

In recent years, environmental issues have come into the spotlight. Use of compounds of lead, chrome, cadmium, etc. is being prohibited or restricted. Therefore, technology not using chrome compounds is being sought.

As the above art, Japanese Patent Publication (B2) No. 57-9631 discloses the method of baking a treatment solution containing colloidal silica in an amount, by $SiO_2$, of 20 parts by weight, aluminum phosphate in an amount of 10 to 120 parts by weight, boric acid in an amount of 2 to 10 parts by weight, and one or more sulfates of Mg, Al, Fe, Co, Ni, and Zn in an amount of 4 to 40 parts by weight at a temperature of 300° C. or more to form an insulating film.

Furthermore, Japanese Patent Publication (A) No. 2000-178760 discloses technology relating to a surface treatment agent for grain-oriented electrical steel sheet containing, as an organic acid salt selected from Ca, Mn, Fe, Zn, Co, Ni, Cu, B, and Al, one or more organic acid salts selected from formates, acetates, oxalates, tartarates, lactates, citrates, succinates, and salicylates.

However, the method disclosed in Japanese Patent Publication (B2) No. 57-9631 has the problem of a drop in the corrosion resistance due to the sulfate ions in sulfates. Further, the technology disclosed in Japanese Patent Publication (A) No. 2000-178760 has a problem relating to solution stabilization, that is, discoloration due to organic acids in the organic acid salts. Further improvement is necessary.

Further, Japanese Patent Publication (A) No. 1-147074 discloses grain-oriented silicon steel sheet provided with an insulating film mainly comprised of a phosphate and colloidal silica in which local regions with large crystallinity degrees are formed.

The insulating film of the grain-oriented silicon steel sheet disclosed in Japanese Patent Publication (A) No. 1-147074 has regions with large crystallinity degrees locally formed in the film, so effectively gives tensile strength to the steel sheet and as a result achieves a reduction in the watt loss.

However, in the above publications, the adhesion of the insulating film is not evaluated. The adhesion of the insulating film is believed to be that of the conventional level. In this respect, the insulating film disclosed in the above publication has room left for improvement.

Japanese Patent No. 348237 discloses assisting the phosphoric acid freed from the hydrogen phosphate in the first layer by adding free phosphoric acid to that first layer and, when adding free phosphoric acid in excess and the amount of phosphoric acid in the first layer becomes in excess, jointly using chromium oxide, thereby not only improving the corrosion resistance, but also preventing sticking at the time of stress-relief annealing by the excess phosphoric acid.

However, the technology disclosed in the above publication requires a second layer mainly comprised of aluminum borate and takes note of the chemical affinity between free phosphoric acid and the second layer. It requires a layered structure comprised of a plurality of layers (first layer and second layer), so has the problem industrially of the cost becoming higher.

DISCLOSURE OF THE INVENTION

The present invention has as its object the improvement of the properties of an insulating film formed on the surface of grain-oriented electrical steel sheet in the final step of the production of that sheet.

That is, the present invention has as its object to obtain grain-oriented electrical steel sheet having a high tensile strength insulating film remarkably superior in adhesion and various other film properties regardless of not containing any chrome compound.

The gist of the present invention is as follows:

(1) Grain-oriented electrical steel sheet having a chrome-free high tensile strength insulating film characterized by comprising a steel sheet on the surface of which is formed an insulating film containing a phosphate and colloidal silica as main ingredients and containing crystalline magnesium phosphate uniformly dispersed over the entire surface.

(2) Grain-oriented electrical steel sheet having a chrome-free high tensile strength insulating film as set forth in (1) characterized in that said crystalline magnesium phosphate contains one or both of monoclinic magnesium phosphate and orthorhombic magnesium phosphate and in that an amount of deposition is 2 to 7 $g/m^2$.

(3) Grain-oriented electrical steel sheet having a chrome-free high tensile strength insulating film as set forth in (1) or (2) characterized in that said phosphate is comprised of one or more phosphates of Ni, Co, Mn, Zn, Fe, Al, and Ba.

(4) Grain-oriented electrical steel sheet having a chrome-free high tensile strength insulating film as set forth in any one of (1) to (3) characterized in that said steel sheet is grain-oriented electrical steel sheet containing C: 0.005% or less and Si: 2.5 to 7.0%, having an average crystal grain size of 1 to 10 mm, and having a deviation of crystal orientation with respect to an ideal orientation of (110) [001] in the rolling direction of an average 8° or less.

(5) A method of treatment of an insulating film of grain-oriented electrical steel sheet characterized by coating, drying, then baking on the surface of grain-oriented electrical steel sheet a treatment agent containing, with respect to 100 parts by weight of phosphate, 40 to 67 parts by weight of colloidal silica and 2 to 50 parts by weight of phosphoric acid and having a total solids content of 15 to 35%.

(6) A method of treatment of an insulating film of grain-oriented electrical steel sheet as set forth in (5) characterized in that said phosphate comprises one or more of phosphates of Ni, Co, Mn, Zn, Fe, Al, and Ba.

(7) A method of treatment of an insulating film of grain-oriented electrical steel sheet as set forth in (5) or (6) characterized in that said steel sheet is grain-oriented electrical steel sheet containing C: 0.005% or less and Si: 2.5 to 7.0%, having an average crystal grain size of 1 to 10 mm, and having a deviation of crystal orientation with respect to an ideal orientation of (110)[001] in the rolling direction of an average 8° or less.

BEST MODE FOR CARRYING OUT THE INVENTION

Figure 1:
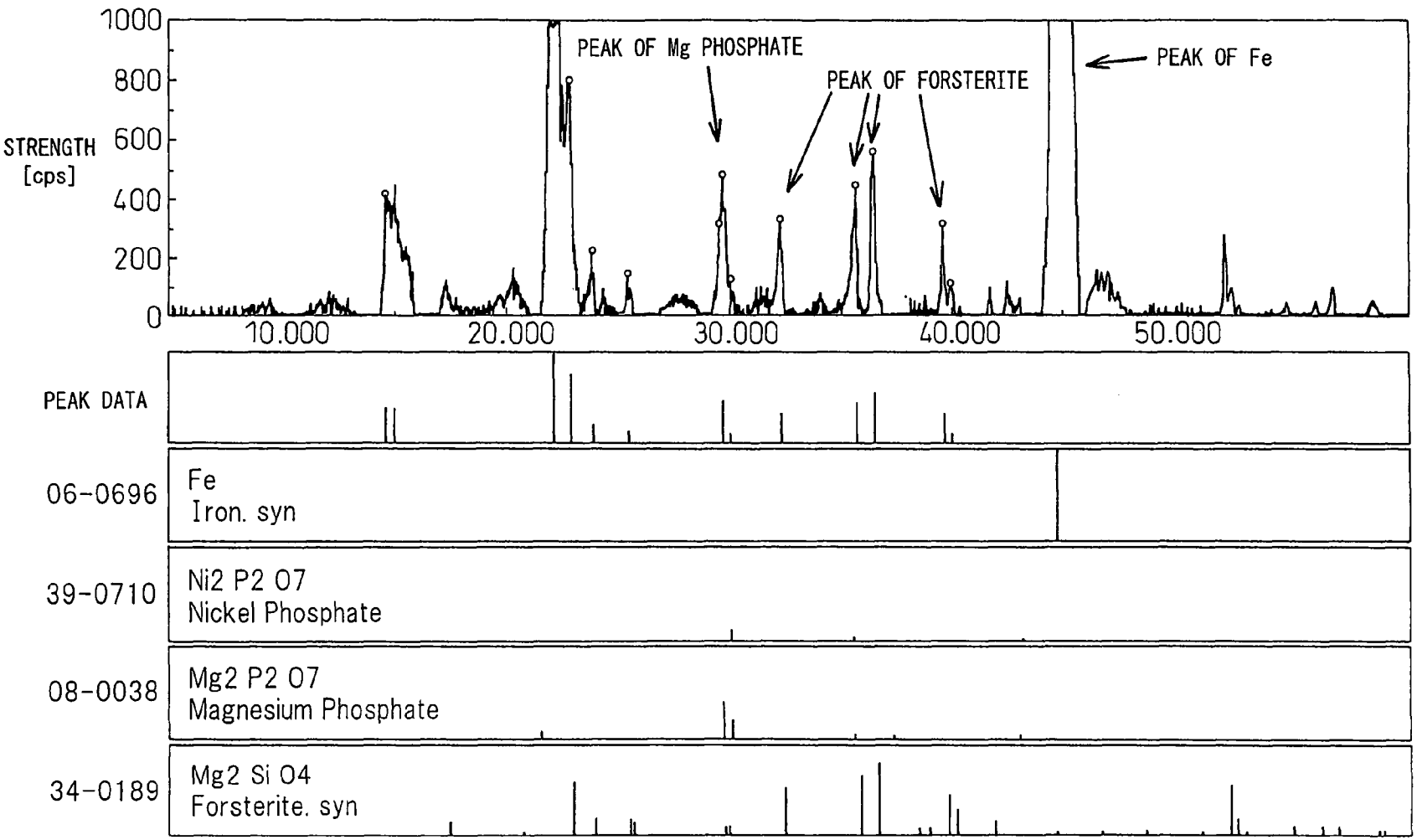
FIG. 1 is a view showing the X-ray diffraction chart of an insulating film formed in Example 1.

Below, the present invention will be explained in more detail.

In the present invention, as the grain-oriented electrical steel sheet after final annealing, a grain-oriented electrical steel sheet having a usual forsterite film is used.

The grain-oriented electrical steel sheet after the final annealing is rinsed, stripped of the excess annealing separator, then pickled in a sulfuric acid bath etc., is further rinsed to clean and activate the surface, then is coated by the treatment solution of the present invention and dried and baked to form the insulating film.

The insulating film of the present invention contains crystalline magnesium phosphate uniformly dispersed over the entire surface of the film. This point is a characterizing feature of the present invention.

Crystalline magnesium phosphate is magnesium phosphate and magnesium hydrogen phosphate present in an orthorhombic, monoclinic, or other crystal form. It is expressed by chemical formula as $Mg_2P_2O_7$ or $Mg_2P_2O_7.H_2O$ and can be easily measured by X-ray spectroanalysis.

The magnesium in the magnesium phosphate contained by the insulating film of the present invention is not supplied from the treatment agent, but is supplied from the forsterite film called the "primary film" formed on the surface of the grain-oriented electrical steel sheet. This point is also a characterizing feature of the present invention.

A forsterite film is a film of a basic compound mainly comprised of an inorganic substance expressed as $Mg_2SiO_4$ and is formed on the surface of steel sheet in a state with fine crystals clustered together.

The present invention achieves an improvement in the film properties by uniformly dispersing and forming crystalline magnesium phosphate between this forsterite film and an insulating film comprised of a phosphate and colloidal silica.

Magnesium phosphate is produced in various crystal systems, but in the present invention, the monoclinic system, orthorhombic system, and hexagonal system are preferred. Among these, in particular the monoclinic system is preferred.

The reason is not clear, but is believed to be as follows:

The forsterite formed on the surface of grain-oriented electrical steel sheet mainly falls under the category of an orthorhombic system. When forming magnesium phosphate on the surface of forsterite, the so-called "casting effect" results in easy formation of the same crystal system, but when the insulating film is formed in a relatively short time, the magnesium phosphate easily takes the form of the low symmetry monoclinic system.

The phosphate used for the insulating film of the present invention is preferably orthophosphate, metaphosphate, or pyrophosphate. Ultraphosphate, triphosphate, or tripolyphosphate is also possible, but other phosphates are low in waterproofness, so the corrosion resistance of the insulating film is degraded. Therefore, caution is required.

The type of metal of the phosphate is preferably one or more selected from Ni, Co, Mn, Zn, Fe, Ba, and Al. The compound added to the insulating film treatment agent is preferably a hydrogen phosphate, carbonate, oxide, or hydroxide of the above metals. In particular, in the case of an oxide, the solubility is low, so complete dissolution is not necessarily required. Even a dispersion or suspension state such as an emulsion or colloid is not a problem.

In the present invention, in addition to the above phosphate, a rust preventive agent, preservative, gloss agent, or other film aids and, further, additives such as silicates and lithium salts may be included in the insulating film. As such additives, phosphates may be used. Further, as the phosphate, magnesium phosphate may be added.

However, in the present invention, formation of crystalline magnesium phosphate is essential. With just addition of magnesium phosphate, the advantageous effects of the present invention cannot be obtained.

The formation of the crystalline magnesium phosphate can be confirmed by using an X-ray diffraction apparatus to analyze the insulating film. The insulating film is a thin film of several μm thickness, so with a simple type X-ray diffraction apparatus, crystalline magnesium phosphate sometimes cannot be detected, but an ordinary X-ray diffraction apparatus, for example, RINT-2000 made by Rigaku etc. can detect it. The apparatus need not have a powerful X-ray source.

In the present invention, the insulating film treatment agent used is characterized by containing not only a phosphate and colloidal silica, but also a phosphoric acid in a specific amount.

The type or brand of the phosphoric acid used in the present invention is not particularly limited, but orthophosphoric acid, meta-phosphoric acid, or polyphosphoric acid is preferable. Depending on the combination with the phosphate, a phosphonate or acidic phosphate may be used.

The "acidic phosphate" referred to in the present invention is comprised of phosphoric acid and caustic soda or another alkaline substance. The solution is in the acidic region. By the heating at the time of baking, the alkaline substance rises in temperature or stabilizes and just phosphoric acid is produced. This may be used to replace the phosphoric acid used in the present invention.

Specifically, sodium primary phosphate etc. exhibiting acidity may be used. Sodium secondary phosphate in the substantially neutral region sometimes can be used depending on the combination with the phosphate used, but sodium tertiary phosphate dissolving in water and exhibiting an alkalinity etc. cannot be used.

The amount of addition of phosphoric acid is limited to 2 to 50 parts by weight with respect to 100 parts by weight of the phosphate. The reason is that if the amount of addition is less than 2 parts by weight, the advantageous effect of the present invention is not sufficiently expressed and the corrosion resistance is liable to be degraded, while if over 50 parts by weight, the stability of the treatment solution will be degraded.

The insulating film treatment agent used in the present invention preferably has a pH of 1 to 4 in range. The reason is that if the pH is less than 1, the acidity is too high and the steel sheet is liable to be corroded and degraded in corrosion resistance, while if over 4, the reactivity with forsterite becomes too low and the moisture adsorption resistance is degraded. A more preferable range of pH is 1 to 2.

The pH may be adjusted by just the repair and amount of addition of the phosphoric acid, but may also be adjusted by using sulfuric acid or another inorganic acid, citric acid or another organic acid, tartaric acid, a buffer solution of sodium tartarate, etc.

The colloidal silica used in the present invention is not particularly limited in particle size, but one of 5 to 50 nm size is preferable, while one of a particle size of 10 to 30 nm is more preferable.

Since the treatment agent is in the acidic region of a pH of 1 to 4, the colloidal silica added is preferably an acidic type, more particularly is preferably one treated with Al on its surface.

The amount of the insulating film formed is limited to 2 to 7 g/m$^2$. If the amount formed is less than 2 g/m$^2$, obtaining a high tensile strength is difficult and, further, the insulating ability, corrosion resistance, etc. also drop. On the other hand, if over 7 g/m$^2$, the coverage rate falls.

Next, the reasons for limitation in the method of treatment of the insulating film will be explained.

The rate of blending of the colloidal silica and phosphate in the treatment agent used in the present invention is, converted to solid content, 40 to 67 parts by weight of colloidal silica to 100 parts by weight of phosphate.

If the amount blended is less than 40 parts by weight, the ratio of the colloidal silica is too small and the tensile strength effect is inferior, while if over 67 parts by weight, the effect of the phosphate as a binder is small and the film-forming ability deteriorates.

The ratio of blending of the phosphoric acid is limited to 2 to 50 parts by weight with respect to 100 parts by weight of the phosphate. If the ratio blended is less than 2 parts by weight, the advantageous effects of the present invention are not obtained and the adhesion and film formability are degraded, while if over 50 parts by weight, the phosphoric acid becomes too great and the hygroscopicity becomes degraded.

In the present invention, while coating and baking the treatment agent, the phosphoric acid added has to undergo a chemical reaction with the forsterite to form magnesium phosphate, so the solids content in the treatment agent is limited to 15 to 35%.

If the solids content is less than 15%, the reactivity between the phosphoric acid and forsterite will become poor, while if cover 35%, the phosphoric acid concentration will become too high, the steel sheet will be corroded, and the corrosion resistance will be degraded. Preferably the content is 20 to 25%.

If the above insulating film treatment is applied to the grain-oriented electrical steel sheet containing C: 0.005% or less and Si: 2.5 to 7.0%, having an average crystal grain size of 1 to 10 mm, and having a deviation of crystal orientation with respect to the ideal orientation of (110)[001] in the rolling direction of an average value of 8° or less produced using the technology disclosed in Japanese Patent Publication (A) No. 7-268567, the effect of further reducing the watt loss is obtained.

The actions and advantageous effects of the present invention are believed to be as follows although the details are not clear.

In general, phosphoric acid and chromic acid chemically react to bond and produce an insoluble compound, so in a conventional grain-oriented electrical steel sheet insulating film comprised of a phosphate, chromate, and colloidal silica, the chromate compound reacts with the phosphoric acid to produce an insoluble compound which makes the insulating film insoluble and improves the water-proofness of the film.

The inventors engaged in repeated studies and as a result discovered that even without chromic acid, if further adding excess phosphoric acid separate from the phosphate, it is possible to improve the water-proofness and film-forming ability of the insulating film.

That is, if limiting the amount of the phosphoric acid blended and the solid content concentration to specific ranges, the phosphoric acid and forsterite will react to form magnesium phosphate and form an insulating film with a high water-proofness.

Magnesium phosphate is produced by the reaction of the magnesium derived from the forsterite and the phosphoric acid derived from the treatment agent, so is present between the forsterite and treatment agent and acts to improve the adhesion of the formed insulating film and forsterite.

According to the present invention, it is possible to obtain grain-oriented electrical steel sheet excellent in magnetic properties having a chrome-free high tensile strength insulating film having a large film tensile strength applied to the surface of the steel sheet and excellent in adhesion and corrosion resistance.

EXAMPLES

Next, the present invention will be explained more specifically based on examples.

(1) Examples 1 to 3 and Comparative Example 1

From a coil of 0.23 mm thick grain-oriented electrical steel sheet after the last final annealing, sample pieces of a width of 7 cm and length of 30 cm were cut out. These were rinsed and lightly pickled to remove the annealing separator remaining on the surface and leave the glass film, then the sample pieces were annealed by stress-relief annealing.

Next, the sample pieces were coated with the phosphoric acid solutions of the formulations shown in Table 1 (insulating film treatment agents) to coating amounts of 4 g/m$^2$, baked, then checked for the formation of crystalline magnesium phosphate by X-ray diffraction.

Table 2 shows the results of evaluation of the film properties and the magnetic properties.

In Comparative Example 1, crystalline magnesium phosphate is not observed and the adhesion and corrosion resistance are inferior.

Figure 2:
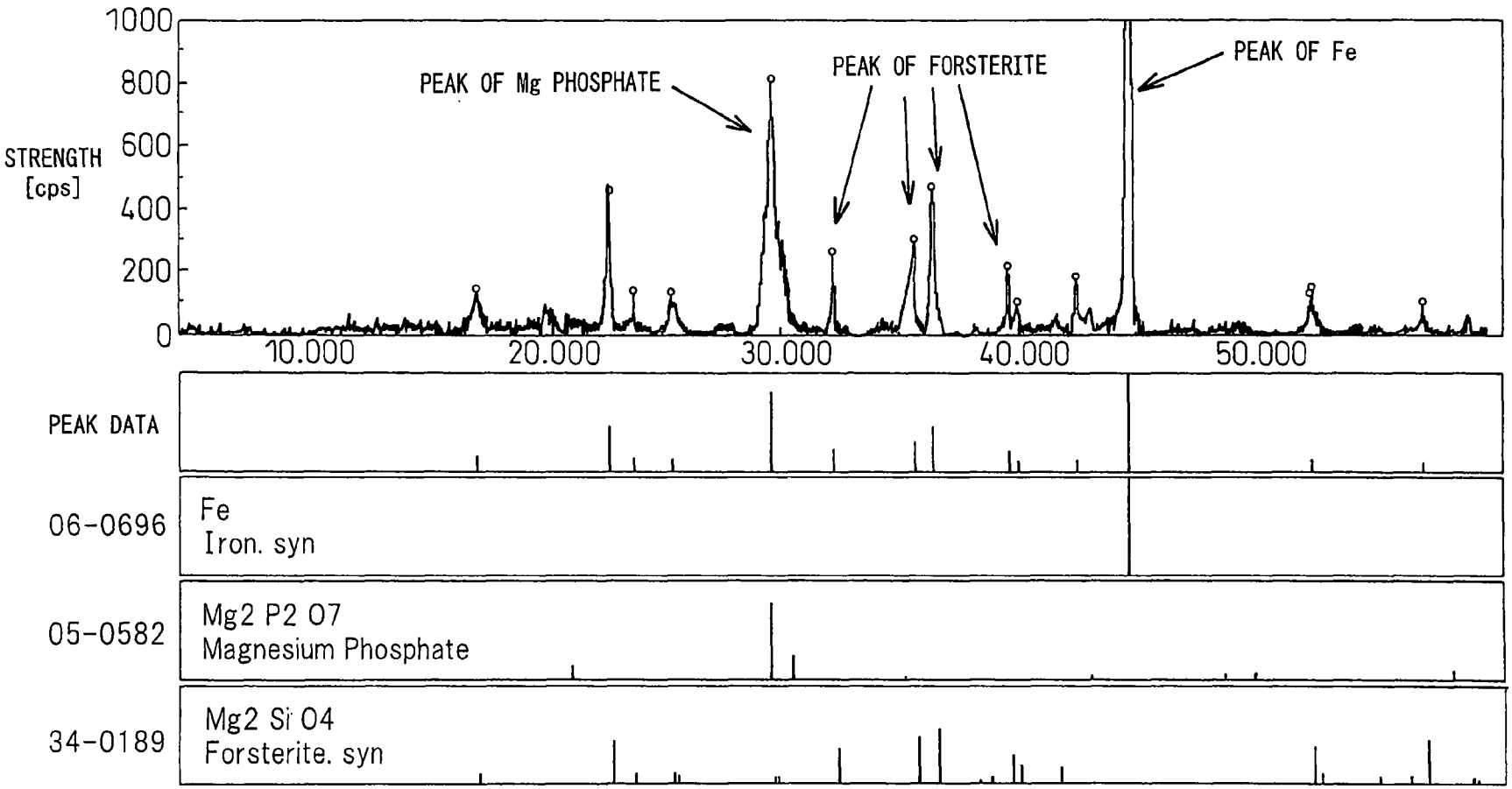
FIG. 2 is a view showing the X-ray diffraction chart of an insulating film formed in Example 2.
Figure 3:
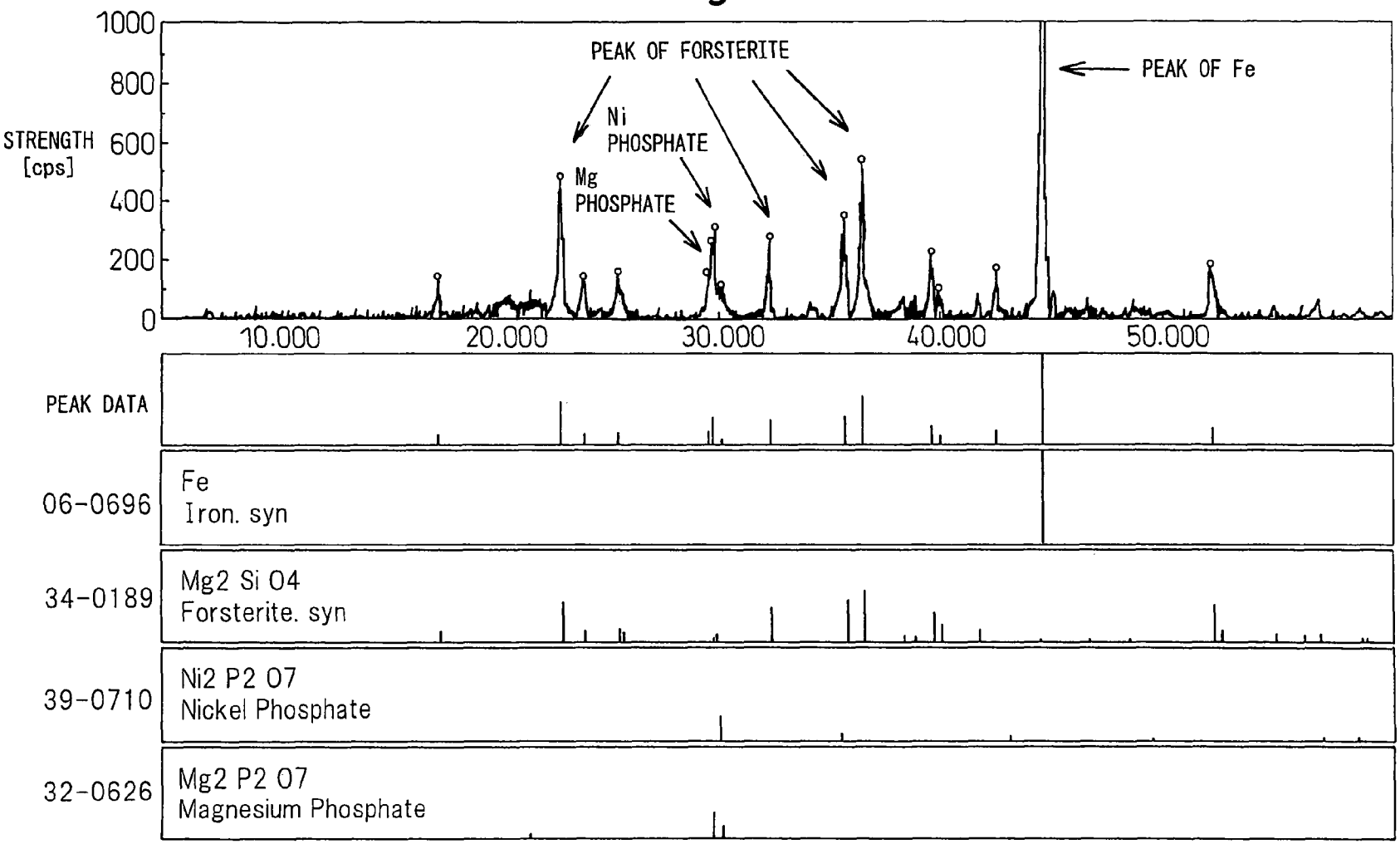
FIG. 3 is a view showing the X-ray diffraction chart of an insulating film formed in Example 3.
Figure 4:
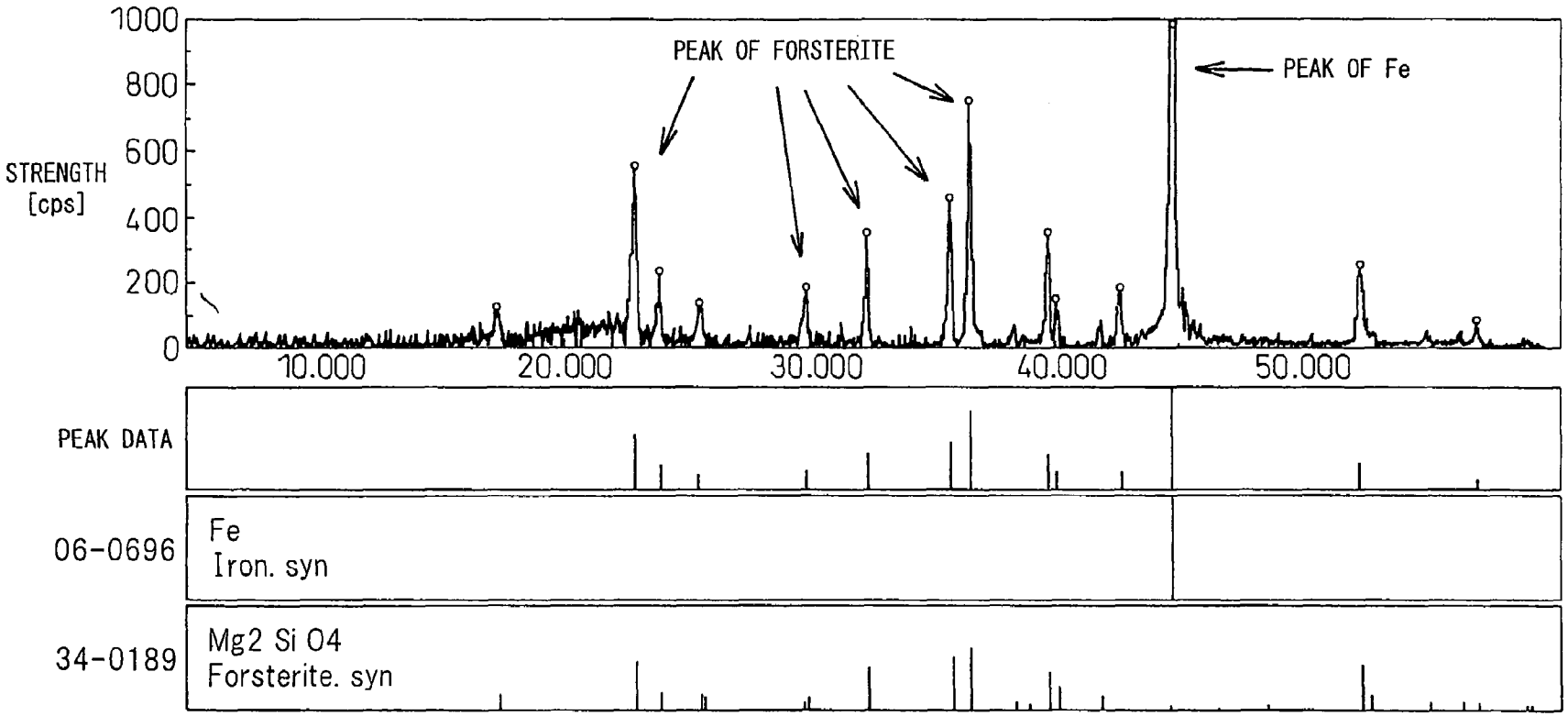
FIG. 4 is a view showing the X-ray diffraction chart of an insulating film formed in Comparative Example 1.

FIG. 1 shows the X-ray diffraction chart of Example 1, FIG. 2 shows the X-ray diffraction chart of Example 2, FIG. 3 shows the X-ray diffraction chart of Example 3, and FIG. 4 shows the X-ray diffraction chart of Comparative Example 1.

The insulating film treatment agents used in Examples 1, 2, and 3 do not contain magnesium phosphate. Despite this, in the X-ray diffraction charts, the peaks of magnesium phosphate appear, so it was confirmed that crystalline magnesium phosphate was produced.

Further, in Comparative Example 1, despite containing magnesium phosphate as a phosphate, in the X-ray diffraction chart, the peak of magnesium phosphate does not appear, so crystalline magnesium phosphate is not obtained.

TABLE 1

| | Phosphate 100 parts by weight | Colloidal silica Parts by weight | Phosphoric acid Type: parts by weight | pH — | Total solids content (%) |
|---|---|---|---|---|---|
| Ex. 1 | Ni phosphate | 52 | o-phosphoric acid: 10 | 2.0 | 21 |
| Ex. 2 | Ni phosphate | 47 | o-phosphoric acid: 26 | 1.8 | 21 |
| Ex. 3 | Al:Ni phosphate = 40:60 | 47 | o-phosphoric acid: 5 | 2.1 | 26 |
| Comp. Ex. 1 | Al:Mg phosphate = 50:50 | 52 | — | 4.2 | 21 |

TABLE 2

| | Film properties | | | | | |
|---|---|---|---|---|---|---|
| | Adhesion (mm) | Corrosion resistance (score) | Film tensile strength (gf/mm$^2$) | Magnetic properties B8 (T) | Magnetic properties W17/50 (W/kg) | Remarks Crystal system of magnesium phosphate |
| Ex. 1 | 0 | 10 | 0.88 | 1.94 | 0.72 | Orthorhombic system |
| Ex. 2 | 0 | 10 | 0.84 | 1.93 | 0.74 | Crystal system unclear |
| Ex. 3 | 0 | 10 | 0.87 | 1.93 | 0.76 | Monoclinic system |
| Comp. Ex. 1 | 20 | 7 | 0.74 | 1.92 | 0.81 | — |

(2) Examples 4 to 10 and Comparative Examples 2 to 8

From a coil of 0.23 mm thick grain-oriented electrical steel sheet after the last final annealing, sample pieces of a width of 7 cm and length of 30 cm were cut out. These were rinsed and lightly pickled to remove the annealing separator remaining on the surface and leave the glass film, then the sample pieces were annealed by stress-relief annealing.

Next, the sample pieces were coated with the phosphoric acid solutions of the formulations shown in Table 3 (insulating film treatment agents) to coating amounts of 4 g/m$^2$, baked, then evaluated for film properties and magnetic properties.

The same method as in Examples 1 to 3 was used to check for the presence of crystalline magnesium phosphate. The results are shown in Table 4.

In Comparative Example 2, the amount of colloidal silica blended is too small, so the film tensile strength is inferior, while in Comparative Example 3, conversely the amount of colloidal silica blended is too large, so the adhesion is inferior.

In Comparative Example 4, the amount of the phosphoric acid blended is too small, so the advantageous effects of the present invention are not obtained and the corrosion resistance is inferior, while in Comparative Example 5, the amount of the phosphoric acid blended is too great, so greasiness is caused and the corrosion resistance becomes extremely poor.

In Comparative Example 6, phosphoric acid is not added and the treatment solution is too high in pH, so the advantageous effects of the present invention are not obtained and the adhesion is inferior, while in Comparative Example 7, the solids content of the treatment solution is too small, so again the advantageous effects of the present invention are not obtained and the adhesion is low.

In Comparative Example 8, conversely the solids content of the treatment solution is too high, corrosion of the steel sheet occurs, unevenness results, and the corrosion resistance is degraded.

TABLE 3

| | Phosphate 100 parts by weight | Colloidal silica Parts by weight | Phosphoric acid Type: parts by weight | pH — | Total solid content (%) |
|---|---|---|---|---|---|
| Ex. 4 | Al phosphate | 52 | o-phosphoric acid: 3 | 1.5 | 30 |
| Ex. 5 | Co phosphate | 62 | o-phosphoric acid: 25 | 1.1 | 25 |
| Ex. 6 | Ni phosphate | 52 | o-phosphoric acid: 40 | 1.2 | 26 |

TABLE 3-continued

| | Phosphate 100 parts by weight | Colloidal silica Parts by weight | Phosphoric acid Type: parts by weight | pH — | Total solid content (%) |
|---|---|---|---|---|---|
| Ex. 7 | Al:Ni phosphate = 50:50 | 52 | o-phosphoric acid: 15 | 1.8 | 21 |
| Ex. 8 | Al:Co phosphate = 50:50 | 45 | Pyro-phosphoric acid: 15 | 2.3 | 18 |
| Ex. 9 | Al phosphate | 47 | o-phosphoric acid: 5 | 2.5 | 21 |
| Ex. 10 | Al:Ba phosphate = 80:20 | 42 | o-phosphoric acid: 12 | 1.9 | 20 |
| Comp. Ex. 2 | Ni phosphate | 35 | o-phosphoric acid: 20 | 1.2 | 24 |
| Comp. Ex. 3 | Al:Ni phosphate = 50:50 | 78 | o-phosphoric acid: 30 | 1.3 | 24 |
| Comp. Ex. 4 | Mn:Ni phosphate = 75:25 | 52 | o-phosphoric acid: 1 | 2.2 | 24 |
| Comp. Ex. 5 | Al:Zn phosphate = 85:15 | 47 | o-phosphoric acid: 55 | 0.74 | 18 |
| Comp. Ex. 6 | Al phosphate | 52 | None added | 4.1 | 18 |
| Comp. Ex. 7 | Al:Ba phosphate = 50:50 | 47 | o-phosphoric acid: 25 | 3.2 | 8 |
| Comp. Ex. 8 | Al:Fe phosphate = 70:30 | 47 | o-phosphoric acid: 15 | 2.1 | 43 |

(3) Examples 11 to 15 and Comparative Examples 9 to 12

Using the technology disclosed in Japanese Patent Publication (A) No. 7-268567, molten steel containing Si: 3.25% was cast, the resultant slab was heated, then hot rolled, the hot rolled sheet was annealed at 1100° C. for 5 minutes, then the sheet was cold rolled to obtain a sheet thickness of 0.22 mm.

This steel sheet was heated by a heating rate of 400° C./sec to 850° C., then was decarburizing annealed, then was coated with an annealing separator and final annealed at 1200° C. for 20 hours.

From the thus obtained coil of the grain-oriented electrical steel sheet having an average particle size of 7.5 mm and a crystal orientation deviated by an average 6.5° from the ideal orientation of (110)[001], test pieces were prepared by the same operation as in Examples 1 to 3.

Next, the test pieces were coated by phosphate solutions of the formulations shown in Table 5 (insulating film treatment agents) to amounts of coating of 4 g/m$^2$ and baked, then were examined for the presence of crystalline magnesium phosphate by the same method as in Examples 1 to 3 and evaluated for film properties and magnetic properties. The results are shown in Table 6.

In Comparative Example 9, the treatment solution is too low in pH, the steel sheet is corroded, and the corrosion

TABLE 4

| | Coating film properties | | | Magnetic properties | | Remarks Surface | Magnesium phosphate |
|---|---|---|---|---|---|---|---|
| | Adhesion (mm) | Corrosion resistance (Score) | Coating film tensile strength (gf/mm$^2$) | B8 (T) | W17/50 (W/kg) | appearance etc. | Crystal system |
| Ex. 4 | 0 | 10 | 0.86 | 1.93 | 0.77 | Glossy, beautiful | Ortho-rhombic system |
| Ex. 5 | 0 | 10 | 0.98 | 1.93 | 0.76 | Somewhat purple, beautiful | Ortho-rhombic system |
| Ex. 6 | 0 | 9 | 0.83 | 1.92 | 0.78 | Smooth, uniform hue | Ortho-rhombic system |
| Ex. 7 | 0 | 10 | 0.89 | 1.93 | 0.77 | Blackish gloss | Monoclinic system |
| Ex. 8 | 0 | 10 | 0.86 | 1.93 | 0.79 | Purplish black-gray color | Ortho-rhombic system |
| Ex. 9 | 0 | 10 | 0.91 | 1.91 | 0.79 | Bright gray-white color, beautiful | Monoclinic system |
| Ex. 10 | 0 | 9 | 0.83 | 1.91 | 0.80 | Uniform hue | Monoclinic system |
| Comp. Ex. 2 | 10 | 10 | 0.36 | 1.91 | 0.91 | Black, uneven | — |
| Comp. Ex. 3 | 30 | 8 | 0.76 | 1.92 | 0.84 | Gray-white color, no gloss | — |
| Comp. Ex. 4 | 10 | 4 | 0.78 | 1.92 | 0.85 | Blackish | — |
| Comp. Ex. 5 | 0 | 4 | 0.71 | 1.91 | 0.92 | Greasiness | — |
| Comp. Ex. 6 | 20 | 7 | 0.81 | 1.91 | 0.82 | No gloss, powder given off | — |
| Comp. Ex. 7 | 30 | 5 | 0.74 | 1.93 | 0.83 | No problem in appearance | — |
| Comp. Ex. 8 | 10 | 3 | 0.46 | 1.90 | 0.89 | Uneven, no gloss | — |

resistance is degraded, in Comparative Example 10, the colloidal silica is added in too great an amount, and, further, in Comparative Example 11, phosphoric acid is not added, so the advantageous effects of the present invention are not exhibited and each was inferior in adhesion.

In Comparative Example 12, the phosphoric acid is released at the time of baking resulting in phosphoric acid compound not in the acidic range, so the advantageous effects of the present invention are not obtained and the adhesion is inferior.

TABLE 5

| | Phosphate 100 parts by weight | Colloidal silica Parts by weight | Phosphoric acid Type: parts by weight | pH — | Total solid content (%) |
|---|---|---|---|---|---|
| Ex. 11 | Mn:Zn phosphate = 50:50 | 52 | Sodium primary phosphate: 5 | 3.4 | 18 |
| Ex. 12 | Co:Zn phosphate = 75:25 | 47 | Poly-phosphoric acid: 25 | 1.2 | 25 |
| Ex. 13 | Co:Ni phosphate = 50:50 | 52 | Acidic sodium meta-phosphate: 3 | 3.2 | 21 |
| Ex. 14 | Al:Ni phosphate = 57:43 | 52 | o-phosphoric acid: 20 | 2.4 | 21 |
| Ex. 15 | Ba:Ni phosphate = 5:95 | 47 | Pyro-phosphoric acid: 15 | 1.7 | 30 |
| Comp. Ex. 9 | Ni:Ba phosphate = 65:35 | 47 | Diphosphoric acid: 72 | 0.7 | 40 |
| Comp. Ex. 10 | Ca:Mg phosphate = 50:50 | 70 | o-phosphoric acid: 20 | 3.2 | 20 |
| Comp. Ex. 11 | Ca:Ni phosphate = 30:70 | 52 | None added | 5.6 | 12 |
| Comp. Ex. 12 | Al:Ni phosphate = 50:50 | 47 | Sodium secondary phosphate: 15 | 5.1 | 21 |

Note that the methods of evaluation of the adhesion, corrosion resistance, and film tensile strength in the above example and comparative examples were as follows:

(1) Adhesion

Cellotape® was adhered to the surface of steel sheets, the sheets were wrapped around tubes of diameters of 10 mm, 20 mm, and 30 mm, and the Cellotape® was peeled off. The smallest diameter (mm) by which the film did not adhere at that time was used for the evaluation.

(2) Corrosion Resistance

35° C. 5% salt water was sprayed. After 5 hours elapsed, the surface was visually evaluated by a 10-point scoring system. 7 points or more were deemed passing.

(3) Film Tensile Strength

One side of a steel sheet was covered by masking tape, then the film was peeled off by alkaline treatment. The film tensile strength was calculated from the degree of bending of the steel sheet.

As a result of the above tests, it was learned that insulating films containing crystalline magnesium phosphate formed using an insulating film treatment agent obtained by adding 40 to 67 parts by weight of colloidal silica and 2 to 50 parts by weight of phosphoric acid to 100 parts by weight of phosphate to obtain a total solids content of 15 to 30% are higher in tensile strength and superior in adhesion and corrosion resistance compared to the insulating films of the comparative examples and are remarkable in effect of improvement of magnetic properties.

As explained above, according to the present invention, it is possible to obtain grain-oriented electrical steel sheet superior in magnetic properties having a chrome-free insulating film with a large film tensile strength and superior adhesion and corrosion resistance.

INDUSTRIAL APPLICABILITY

As explained above, according to the present invention, it is possible to obtain grain-oriented electrical steel sheet supe-

TABLE 6

| | Coating film properties | | | | | | |
|---|---|---|---|---|---|---|---|
| | | Corrosion | Coating film tensile | Magnetic properties | | Remarks Surface | Magnesium phosphate |
| | Adhesion (mm) | resistance (Score) | strength (gf/mm$^2$) | B8 (T) | W17/50 (W/kg) | appearance etc. | Crystal system |
| Ex. 11 | 0 | 10 | 0.85 | 1.94 | 0.69 | Uniform hue, beautiful | Monoclinic system |
| Ex. 12 | 0 | 10 | 0.93 | 1.95 | 0.70 | Glossy, smooth | Ortho-rhombic system |
| Ex. 13 | 0 | 9 | 0.91 | 1.94 | 0.70 | Uniform hue | Ortho-rhombic system |
| Ex. 14 | 0 | 10 | 0.97 | 1.95 | 0.67 | Uniform, glossy | Monoclinic system |
| Ex. 15 | 0 | 10 | 0.90 | 1.93 | 0.73 | Uniform, beautiful | Ortho-rhombic system |
| Comp. Ex. 9 | 10 | 3 | 0.67 | 1.92 | 0.81 | Steel plate corroded | — |
| Comp. Ex. 10 | 20 | 9 | 0.74 | 1.94 | 0.76 | Cloudy white, no gloss | — |
| Comp. Ex. 11 | 20 | 5 | 0.80 | 1.93 | 0.77 | Rough surface | — |
| Comp. Ex. 12 | 20 | 9 | 0.45 | 1.94 | 0.80 | No gloss, whitish | — |

rior in magnetic properties having a chrome-free high strength insulating film having a large film tensile strength applied to the surface of the steel sheet and excellent in adhesion and corrosion resistance.

Accordingly, the present invention expands the applications for grain-oriented electrical steel sheet and has great industrial applicability.

The invention claimed is:

1. Grain-oriented electrical steel sheet having a forsterite film on its surface and a chromium free high tensile strength insulating film on the surface of said forsterite film, the insulating film containing a first phosphate and a colloidal silica as main ingredients and one or more of monoclinic magnesium phosphate, orthorhombic magnesium phosphate, and hexagonal magnesium phosphate uniformly dispersed between said insulating film and said forsterite film.

2. Grain-oriented electrical steel sheet as set forth in claim 1, characterized in that the insulation film is in an amount of 2 to 7 $g/m^2$.

3. Grain-oriented electrical steel sheet as set forth in claim 1, characterized in that said first phosphate is comprised of one or more phosphates of Ni, Co, Mn, Zn, Fe, Al, and Ba.

4. Grain-oriented electrical steel sheet as set forth in claim 1, characterized in that said steel sheet is grain-oriented electrical steel sheet containing C: 0.005% or less and Si: 2.5 to 7.0%, having an average crystal grain size of 1 to 10 mm, and having a deviation of crystal orientation with respect to an ideal orientation of (110)[001] in the rolling direction of an average 8° or less.

5. A method of treatment of a chromium free high tensile strength insulating film of grain-oriented electrical steel sheet having on its surface a forsterite film, characterized by coating, drying, then baking on the surface of grain-oriented electrical steel sheet a treatment agent containing, with respect to 100 parts by weight of phosphate, 40 to 67 parts by weight of colloidal silica and 2 to 50 parts by weight of phosphoric acid and having a total solids content of 15 to 35% to form an insulating film containing a first phosphate and a colloidal silica as main ingredients and one or more of monoclinic magnesium phosphate, orthorhombic magnesium phosphate, and hexagonal magnesium phosphate uniformly dispersed between the insulating film and the forsterite film.

6. A method of treatment of a chromium free high tensile strength insulating film of grain-oriented electrical steel sheet as set forth in claim 5, characterized in that said first phosphate comprises one or more of phosphates of Ni, Co, Mn, Zn, Fe, Al, and Ba.

7. A method of treatment of a chromium free high tensile strength insulating film of grain-oriented electrical steel sheet as set forth in claim 5, characterized in that said steel sheet is grain-oriented electrical steel sheet containing C: 0.005% or less and Si: 2.5 to 7.0%, having an average crystal grain size of 1 to 10 mm, and having a deviation of crystal orientation with respect to an ideal orientation of (110)[001] in the rolling direction of an average 8° or less.

* * * * *